United States Patent [19]

Dewey, III

[11] Patent Number: 4,986,227

[45] Date of Patent: Jan. 22, 1991

[54] VARIABLE LIFT VALVE TRAIN

[76] Inventor: Albert B. Dewey, III, 3424 Washington Dr., Falls Church, Va. 22041

[21] Appl. No.: 520,550

[22] Filed: May 8, 1990

[51] Int. Cl.[5] ..... F01L 1/18

[52] U.S. Cl. ..... 123/90.16; 123/90.39; 123/90.41; 123/90.44

[58] Field of Search ..... 123/90.16, 90.27, 90.39, 123/90.41, 90.44, 90.45, 90.47

[56] References Cited

U.S. PATENT DOCUMENTS

| | | | |
|---|---|---|---|
| 4,498,432 | 2/1985 | Hara et al. | 123/90 |
| 4,519,345 | 5/1985 | Walter | 123/90.39 |
| 4,523,550 | 6/1985 | Matsuura et al. | 123/90.16 |
| 4,526,142 | 7/1985 | Hara et al. | 123/90.16 |
| 4,638,773 | 1/1987 | Bonvallet | 123/90.16 |
| 4,724,822 | 2/1988 | Bonvallet | 123/90.16 |
| 4,774,913 | 10/1988 | Giampa et al. | 123/90.16 |
| 4,898,130 | 2/1990 | Parsons | 123/90.39 |
| 4,911,124 | 3/1990 | Bennett | 123/90.16 |

FOREIGN PATENT DOCUMENTS

| | | | |
|---|---|---|---|
| 262306 | 1/1929 | Italy | 123/90.16 |
| 216226 | 8/1941 | Switzerland | 123/90.16 |

*Primary Examiner*—Charles J. Myhre

*Assistant Examiner*—Weilun Lo

*Attorney, Agent, or Firm*—Kerkam, Stowell, Kondracki & Clarke

[57] ABSTRACT

A variable lift valve train mechanism for an internal combustion engine. The valve train varies valve lift depending on engine RPM, providing a relatively lower valve lift at lower engine RPMs for increased bottom-end torque and a relatively higher valve lift at higher engine RPMs for increased overall top-end performance. The valve train includes a rocker arm at one end engaging a valve and at its other end engaging a cam such that upward movement of the cam causes downward opening movement of the valve. The rocker arm has a convex fulcrum-engaging upper surface extending between the rocker arm ends. A variable-position fulcrum assembly includes a pivot arm, the lower end of which is pivotally mounted to a pivot point, and the upper end of which carries a fulcrum roller element engaging the fulcrum-engaging upper surface of the rocker arm to define a variable fulcrum point. A control element in the form of a control piston driven by engine oil pressure positions the pivot arm and thus the fulcrum point to vary valve lift. To selectively restrict engine performance, a pressure relief valve may be provided for limiting the oil pressure to the control piston.

15 Claims, 5 Drawing Sheets

VARIABLE LIFT VALVE TRAIN

BACKGROUND OF THE INVENTION

The present invention relates generally to valve train mechanisms for internal combustion engines and, more particularly, to a variable lift valve train mechanism.

Valve "lift" may be defined as the degree of opening movement of an intake or exhaust poppet valve with movement of a valve actuator such as a cam lobe having a given profile. In this context, the term "lift" does not imply movement in a particular direction (up or down). Typical static (non-variable) lift valve trains for internal combustion engines are designed as a compromise with reference to engine performance at various RPMs. Generally, the more powerful engines are designed with a relatively higher valve lift camshaft and develop their maximum horsepower and torque at higher RPMs, with a sacrifice in terms of overall fuel economy. Conversely, the more fuel efficient engines generally have relatively lower valve lift camshafts and concentrate their horsepower and torque at lower engine RPMs, but lack the ability to generate high usable power. In short, conventional engine design has the effect of positioning a point of maximum volumetric efficiency either higher up or lower down on the RPM scale.

A number of variable lift valve train mechanisms have been proposed, typical examples being disclosed in Hara et al U.S. Pat. No. 4,526,142, Hara et al U.S. Pat. No. 4,498,432, and Bonvallet U.S. Pat. No. 4,638,773. Generally, in such mechanisms, a rocker arm is positioned so that one end thereof is actuated either directly by a cam, as in an overhead cam engine, or by a cam-actuated push rod. The other end of the rocker arm engages the free stem end of a poppet valve, such as an intake valve or an exhaust valve. The upper surface of the rocker arm has a contoured portion which abuts an upper, plate-like reaction member, with the contact point between the rocker arm and the reaction member serving as the pivot or fulcrum point of the rocker arm. Various arrangements have been proposed for varying the angle or orientation of the upper reaction member, thereby to alter the pivot or fulcrum point and thus vary valve lift.

SUMMARY OF THE INVENTION

It is an object of the present invention to provide an efficient and improved variable lift valve train mechanism, particularly for overhead cam operation.

It is another object of the invention to provide a variable valve lift mechanism which varies valve lift depending on engine RPM, more particularly, to provide a relatively lower valve lift at lower RPMs so as to increase bottom-end torque, and to provide a relatively higher valve lift at higher RPMs so as to increase overall top-end performance.

It is a related object of the invention to provide a variable lift valve train mechanism which minimizes the need for compromise in the design of internal combustion engines by facilitating engine designs with a broad power band over a range of engine RPMs.

It is yet another object of the invention to provide a variable valve lift mechanism which is controllable to selectively prevent high performance actuation of the valve train by limiting the amount of valve lift to a preset cutoff point for such purposes as provided excellent fuel economy full time while permitting instant "power on" when desired, or a high-power "lockout" feature for valet parking purposes or for limiting abuse of an automobile by younger drivers.

Briefly, in accordance with the invention a variable lift valve train is provided which includes a valve, a valve actuator including a cam, and a rocker arm. The rocker arm at one end engages the valve and at its other end engages the valve actuator, for example the cam, such that movement of the valve actuator generally in one direction, for example in an upward direction, causes movement of the valve generally in an opposite direction, in this example in a downward direction. In accordance with the invention, the rocker arm has a fulcrum-engaging surface extending generally between the rocker arm ends, which fulcrum-engaging surface preferably is convex and comprises the upper surface of the rocker arm.

Also included in a variable-position fulcrum assembly including a pivot arm. One end of the pivot arm, for example the lower end, is pivotally mounted to a pivot point, while the other end, in this example the upper end, carries a fulcrum element, such as a roller, engaging the rocker arm fulcrum-engaging surface to define a variable fulcrum point. The position of the pivot arm thus determines the position of the variable fulcrum point along the fulcrum-engaging surface of the rocker arm.

At one end position of the pivot arm the variable fulcrum point is near the valve actuator end of the rocker arm for maximum movement of the valve with the movement of the valve actuator, that is, for maximum valve "lift". At the other end position of the pivot arm the variable fulcrum point is near the valve end of the rocker arm minimum movement of the valve with movement of the valve actuator, that is, for minimum valve "lift".

A control element engages the pivot arm for setting the position of the pivot arm, thereby controlling the position of the fulcrum point and thus valve "lift". In the context of an internal combustion engine, in accordance with the invention the control element operates to move the pivot arm in a direction towards the position where the variable fulcrum point is positioned for maximum valve "lift" as engine RPM increases.

Preferably, through the use of a control piston, the position of the pivot arm is determined by hydraulic pressure, specifically, engine oil pressure, which normally increases with increasing engine RPM.

More particularly, in accordance with the invention the variable-position fulcrum assembly includes a biasing element, such as a spring, connected to the pivot arm for biasing the pivot arm in the direction towards the position where the variable fulcrum point is positioned for minimum valve "lift." The control element includes a control piston received in a piston bore and having a piston tip element, preferably a roller mounted by means of needle bearings for free rotation on a tip element shaft, with the tip element engaging a push plate attached to the pivot arm. The control piston and piston bore are arranged for movement of the piston along a path generally at a right angle to the push plate such that movement of the control piston in a direction out of the bore moves the pivot arm in a direction towards a position where the variable fulcrum point is positioned for maximum valve "lift." A passageway is provided for introducing hydraulic fluid, preferably engine oil, under pressure into the piston bore for moving the control piston in a direction out of the bore.

Another feature of the invention is selective restriction of engine performance. Thus, there may be provided a pressure relief element, such as a pressure relief valve, for limiting the oil pressure which may be applied through the passageway to the control piston, thereby limiting valve "lift."

Preferably an adjustment element is provided at the end of the rocker arm engaging the valve actuator for adjusting clearance between the valve actuator and the rocker arm. In the case where the valve actuator is an overhead cam, the rocker arm end includes a cam follower roller mounted for free rotation, such as by means of needle bearings, on an adjustable shaft. The adjustable shaft includes an offset longitudinal bore receiving a mounting element about which the adjustable shaft may be eccentrically rotated for adjustment. The mounting element includes means, such as a bolt and nut for applying compression, for fixing the adjustable shaft in a desired adjusted position.

Another feature of the invention provide for positively locating the rocker arm with respect to the remainder of the mechanism. Thus, the valve includes a valve stem constrained for longitudinal movement. One end of the rocker arm includes a semi-spherical recess, and a hat element is mounted on the valve stem, the hat element having a semi-spherical portion engaging the semi-spherical recess.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

DETAILED DESCRIPTION OF THE PREFERRED EMBODIMENTS

Figure 1:
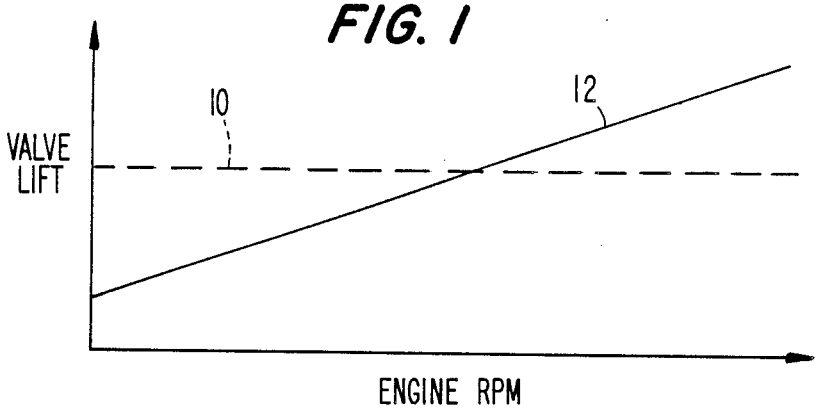
FIG. 1 is a graph representing and comparing valve lift as a function of RPM conventionally and in accordance with the invention.

FIG. 1 is a simplified graph depicting valve lift as a function of engine RPM. More particularly, a dash line 10 in FIG. 1 depicts valve lift provided by a conventional valve train assembly, and a solid line 12 generally depicts valve lift provided by the valve train of the present invention. Although the line 12 depicting the operation of the invention is a straight line in FIG. 1, it will be appreciated that this is a representation only, and that in actual practice valve lift is not necessarily a linear function of engine RPM.

As noted above, valve "lift" may be defined as the degree of opening movement of a poppet valve with movement of the valve actuator specifically, a cam lobe. Thus, in the system of the invention, the same relative movement of the cam lobe results in varying amounts of valve opening movement or "lift," depending on engine RPM.

Figure 2:
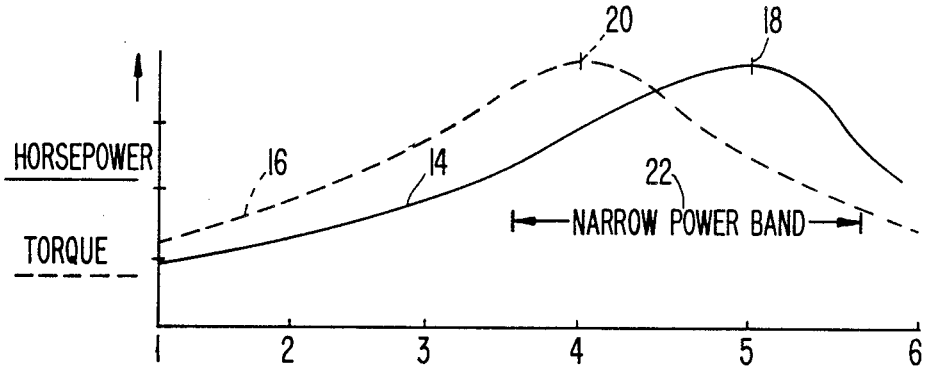
FIG. 2 depicts typical horsepower and torque curves such as are achieved with standard static-lift valve trains.

FIG. 2 depicts representative horsepower (solid line 14) and torque (dash line 16) curves produced by an internal combustion engine with a standard static (non-variable) lift valve train. Evident in FIG. 2 are a pair of "sweet spots" 18 and 20 where horsepower and torque respectively peak, and a representative relatively narrow power band 22.

As may be seen, such a typical design is basically a compromise between placing the amount of power that the engine will generate either high up on the RPM scale or low down on the RPM scale. Each assembly designed in this way will invariable have the "sweet spots" 18 and 20. Such becomes a problem when one desires to design an engine that is both powerful and fuel efficient at the same time. As noted above, the more powerful engines generally develop their horsepower and torque at higher RPMs, with sacrifices in terms of overall fuel efficiency. The more fuel efficient engines concentrate their power at lower RPMs, but lack the ability to generate much usable power. This problem arises because the more powerful engine is designed with a higher valve lift camshaft, while the economy engine is designed with a relatively lower valve lift camshaft. Thus, the point of maximum volumetric efficiency is placed either higher up or lower down on the RPM scale.

Figure 3:
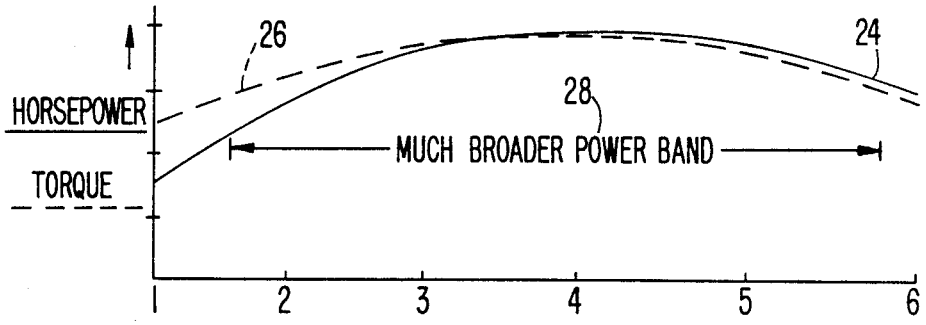
FIG. 3 is a contrasting graph depicting typical horsepower and torque curves such as may be achieved in accordance with the variable-lift valve train of the subject invention.

As represented in FIG. 3, in contrast the variable valve lift approach of the invention results in horsepower (solid line 24) and torque (dash line 26) curves which are more uniformly higher over a much broader power band 28.

Figure 4:
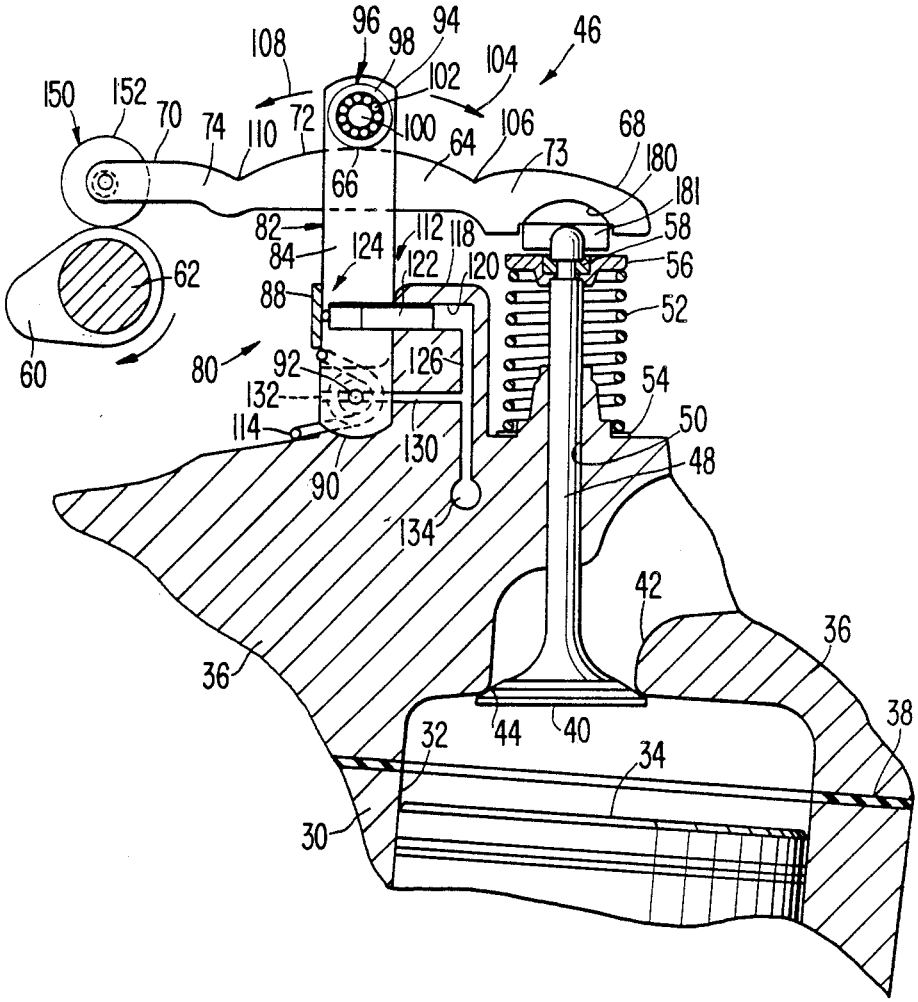
FIG. 4 is an elevational view, partly in section, of a portion of an internal combustion engine with a variable lift valve train in accordance with the invention, with the poppet valve shown in its closed position and the variable-position fulcrum assembly of the invention in an intermediate position.

Referring now to the elevational view of FIG. 4, shown in a portion of an overhead valve, overhead cam internal combustion engine. An engine block 30 has a cylinder 32 within which a piston 34 reciprocates. A cylinder head 36 is attached to the engine block 30, with a head gasket 38 therebetween. The cylinder had 36 includes a valve 40 in the form of a poppet valve used for either intake or exhaust, which is operatively mounted to control fluid flow through a port 42 encircled by a conventional valve seat 44. The valve 40 comprises a portion of a variable lift valve train in accordance with the invention, generally designated 46.

The valve 40 includes a valve stem 48 constrained by a valve stem guide bore 50 for axial movement or reciprocation. As in conventional, the valve 40 is normally maintained in its closes position depicted in FIG. 4 by a valve return spring 52. The lower end of the spring 52 rests on an annular spring seat 54, while the upper end of the valve return spring 52 is compressed by a valve spring retainer 56 and a conventional keeper device 58.

An overhead cam 60 is carried by a rotating camshaft 62 in a conventional manner, and comprises a valve actuator. While the variable lift valve train of the invention is shown in the context of an overhead cam engine, it will be appreciated that it can readily be modified for use with a push rod engine. However, the overhead cam embodiment is preferable due to the relatively higher reciprocating weight of a push rod and lifter assembly, which otherwise would require a heavier valve spring, thereby increasing the force required to operate the system and likewise reducing the overall fuel efficiency of the engine.

The variable lift valve train 46 includes a rocker arm 64 which comprises a lever pivoting about a variable-position fulcrum point 66. One end 68 of the rocker arm 64 engages the valve 40, more particularly the end of the valve stem 48, and the other end 70 of the rocker arm 64 engages the valve actuator comprising the cam 60. The rocker arm 64 has a convex fulcrum-engaging surface 72 extending generally between the rocker arm ends 68 and 70. In the particular arrangement shown, the convex fulcrum-engaging surface 72 is the upper surface of the rocker arm 64. However, it will be appreciated that other geometries are possible wherein the fulcrum-engaging surface would comprise a lower surface of the rocker arm 64, including other geometries where the fulcrum-engaging surface is concave.

In any event, movement of the valve actuator comprising the cam 60 in one direction, in this embodiment in an upward direction, causes movement of the valve 40 generally in an opposite direction, in this embodiment, in a downward direction to open the valve 40.

It will be appreciated that a pair of lever arms 73 and 74 are thus defined, the lever arm 73 extending from the pivot point 66 to the one end 68 of the rocker arm, and the lever arm 74 extending from the pivot point 66 to the other end 70 of the rocker arm 64. The ratio of the lengths of the two lever arms 73 and 74 thus defined determines the degree of movement of the valve 40 with movement of the valve actuator 60. Varying the position of the fulcrum point 66 has the effect of varying the ratio between the lengths of the lever arms 73 and 74, and accordingly varying the amount of valve "lift."

Figure 5:
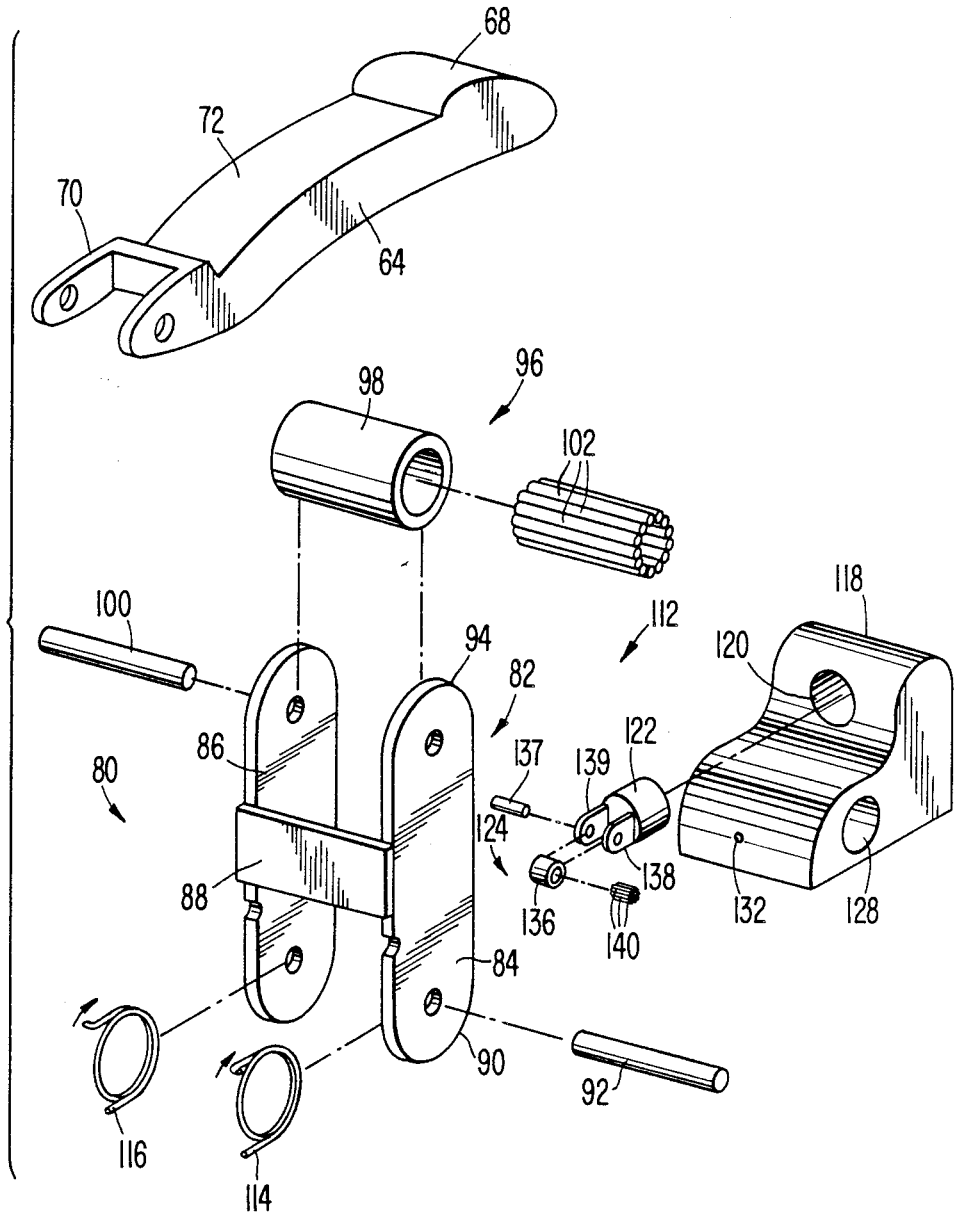
FIG. 5 is a three-dimensional exploded view depicting further details of the variable-position fulcrum assembly of the invention.

Referring now to FIG. 5 in addition to FIG. 4, the variable lift valve train 46 includes a variable-position fulcrum assembly, generally designated 80, having a pivot arm 82 comprising a pair of side plates 84 and 86 joined by an attached push plate 88. One end 90 of the pivot arm 82 is pivotally mounted to a pivot point 92 comprising a bottom pivot pin 92, and the other end 94 of the pivot arm carries a fulcrum element generally designated 96 engaging the rocker arm 64 fulcrum-engaging surface 72 to define the variable fulcrum point 66. It will be appreciated that the position of the pivot arm 82 determines the position of the variable fulcrum point 66 along the rocker arm fulcrum-engaging surface 72.

As best seen in FIG. 4, the fulcrum-engaging surface 72 has a semi-cylindrical curvature defined as a locus equidistant from the pivot point 92 of the variable-position fulcrum assembly 96. For free movement, the fulcrum-engaging element 96 preferably comprises a roller needle bearing assembly comprising an outer roller 98 rotating about a center pin or race 100 with a set 102 of needle bearings in between.

The pivot arm 82 is thus free to move either in a direction represented by arrow 104 towards a position 106 where the variable fulcrum point 66 is positioned for minimum movement of the valve 40 with movement of the valve actuator 60, that is, for minimum valve "lift," under which conditions the lever arm 73 is shorter than the lever arm 74, or in a direction represented by an arrow 108 towards a position 110 where the variable fulcrum point 66 is positioned for maximum movement of the valve 40 with movement of the valve actuator 60, that is, for maximum valve "valve," under which conditions the lever arm 73 is longer than the lever arm 74.

For setting the position of the pivot arm 82, a control element, generally designated 112, is provided. The control element 112 serves, an engine RPM increases, to move the pivot arm 82 in the direction 108 towards the position 110 where the variable fulcrum point 66 is positioned for maximum valve "lift, " and conversely, as engine RPM decreases, to move the pivot arm 82 in the direction 104 towards the position 106 where the variable fulcrum point 66 is positioned for minimum valve "lift."

More particularly, the variable-position fulcrum assembly 80 includes a biasing element, in this embodiment a pair of return springs 114 and 116, for biasing the pivot arm 82 in the direction 104 towards the position 106 where the variable fulcrum point 66 is positioned for minimum valve "lift." An upwardly-protruding base element 118 structure is suitable formed as part of or, alternatively, attached to the cylinder head 36 and includes a piston bore 120 receiving a control piston 122 having a piston tip element, generally designated 124, engaging the push plate 88. The control piston 122 and piston bore 120 are arranged for movement of the piston 122 along a path generally at a right angle to the push plate 88 such that movement of the control piston 122 in a direction out of the bore 120 moves the pivot arm 82 in a direction towards a position where the variable fulcrum point 66 is positioned as at point 110 for maximum valve "lift." Included within the base element 118 is a passageway 126 for introducing hydraulic fluid under pressure into the piston bore 120 for moving the control piston 122 in a direction out of the bore.

Figure 7:
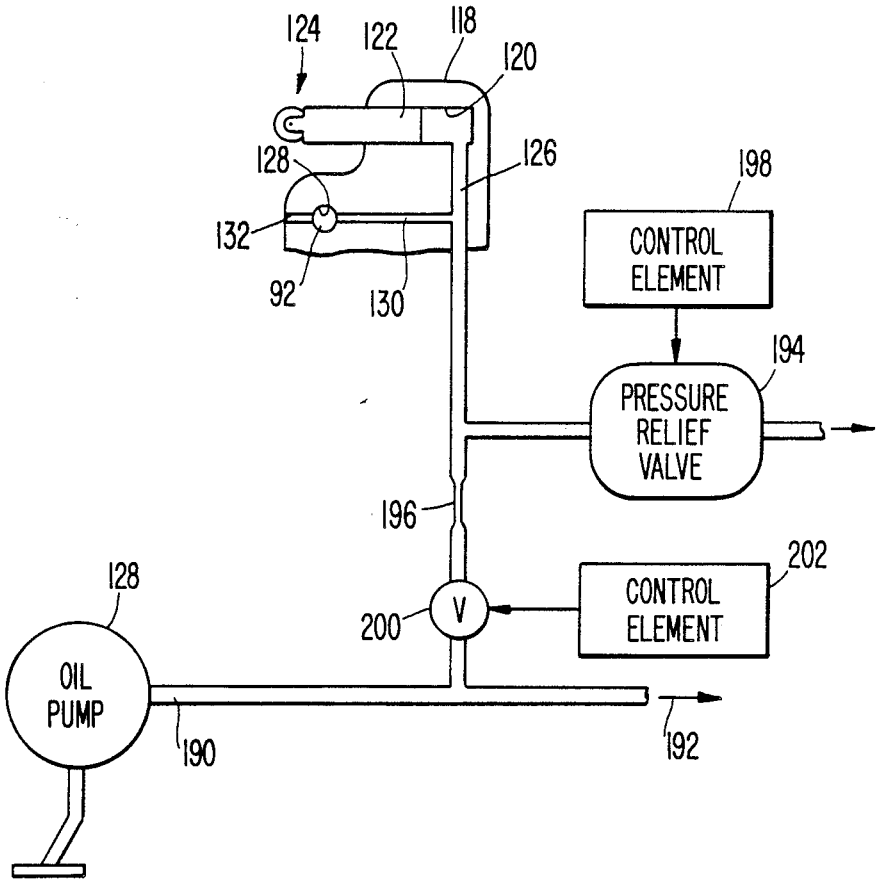
FIG. 7 is a schematic diagram depicting various control approaches in accordance with the invention.

Preferably, and as represented schematically in FIG. 7, the hydraulic fluid introduced through the passageway 126 is engine oil pumped by an engine-driven oil pump 128 such that movement of the fulcrum assembly 96 in the direction 108 towards maximum valve "lift" occurs with increasing engine RPM.

For convenience, the bottom pivot pin 92 is received in a bore 128 in the base element 118, and lubricated through a subsidiary passageway 130 terminating at an outlet 132. Oil is supplied to the passageways 126 and 130 from a representative main oil passageway 134 (FIG. 4).

For minimum friction, the piston tip element 124 more particularly comprises a roller 136 mounted for free rotation on a tip element shaft 137 supported between forked end elements 138 and 139, with needle bearings 140 between the tip element shaft 137 and the roller 136.

Figure 6:
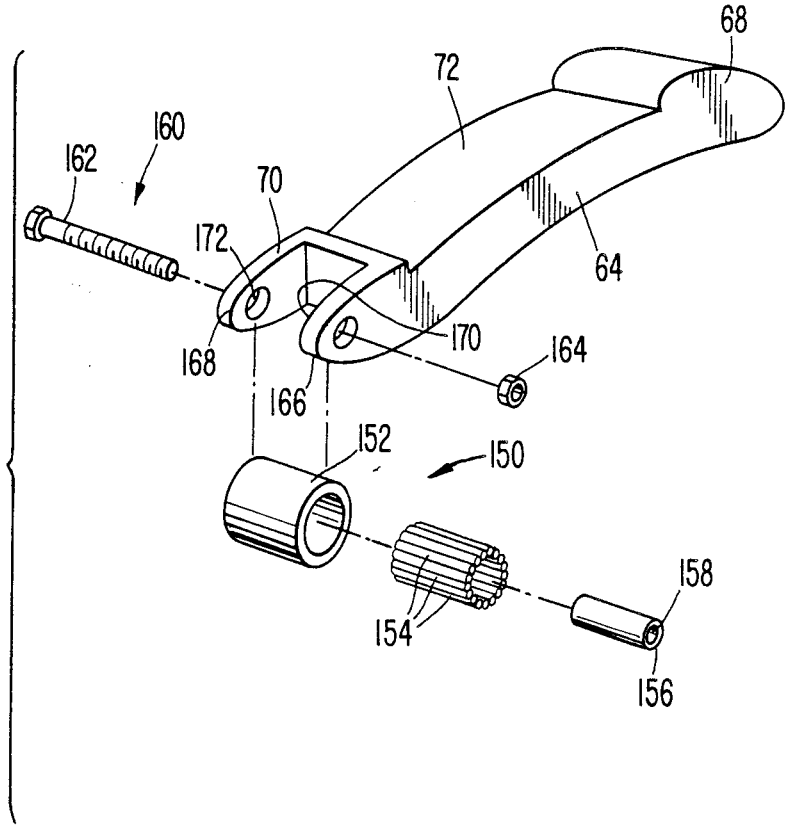
FIG. 6 similarly is a three-dimensional exploded view depicting the clearance adjustment element of the invention.

Referring now to FIG. 6 in addition to FIG. 4, at the other end 70 of the rocker arm 64 engaging the valve actuator or cam 60 is a cam follower assembly 150 including an adjustment element for adjusting clearance between the valve actuator 60 and the rocker arm 64. More particularly, the cam follower assembly 150 includes a cam follower roller 152 supported on needle bearings 154 for rotation about a shaft 156. The shaft 156 is adjustable, and includes a radially offset longitudinal bore 158 receiving a mounting element 160 about which the adjustable shaft 156 may be eccentrically rotated for adjustment. The mounting element 160 serves to fix the adjustable shaft 156 in a desired adjusted position, and may simply comprise a bolt 162 and nut 164 for applying compressive forces between forked end elements 166 and 168 of the rocker arm other end 70, thereby compressing the adjustable shaft 156 between surfaces 170 and 172.

For locating the rocker arm 64 with respect to the remainder of the assembly, as may be seen in FIG. 4, the one rocker arm end 68 includes a semi-spherical recess 180 which cooperates with a dome-shaped hat element 181 mounted on the valve stem 48 and having a semi-spherical portion engaging the semi-spherical recess 180.

At the rocker arm end 68 located more specifically within the semi-spherical recess 180 is a hole drilled through the rocker arm end 68 to provide oiling for the top surface of the dome-shaped hat element 181.

Referring finally to FIG. 7, depicted are several control approaches in accordance with the invention. As described hereinabove, the engine-driven oil pump 128 delivers oil under pressure depending upon engine RPM. The oil pump 128 has an outlet 190 which discharged the bulk of the oil flow as at 192 for general engine lubrication purposes. A portion of the oil from the pump 128 is delivered via the passageway 126 to drive the control piston 122.

To limit the amount of valve "lift," a controllable pressure relief valve 194 may be provided which, in conjunction with a flow restrictor 196, limits the oil pressure which may be supplied to the cylinder 120. The pressure relief valve is under the control of a control element 198, which may be either manual or computerized.

The system may additionally include a control valve 200, similarly under the control of a control element 202, for entirely preventing the flow of oil pressure to actuate the control piston 122.

Thus, a feature of the present invention is that the variable valve "lift" is hydraulically controlled. Accordingly, a variety of control approaches may readily be incorporated by way of pressure relief functions to prevent high performance actuation of the valve train by limiting the amount of "lift" to a preset cutoff point. As described hereinabove, such has the effect of providing excellent fuel economy full time yet either through computer or manual intervention have instant "power on" when desired. These approaches also allow for a lower power "lock in," high power "lock out" feature such as for value packing purposes.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A variable lift valve train comprising:

a valve;

a valve actuator including a cam;

a rocker arm at one end engaging said valve and at its other end engaging said valve actuator such that movement of said valve actuator generally in one direction causes movement of said valve generally in an opposite direction, said rocker arm having a fulcrum-engaging surface extending generally between said rocker arm ends; and a variable-position fulcrum assembly including:

a pivot arm, said pivot arm at one end pivotally mounted to a pivot point and at its other end carrying a fulcrum element engaging said rocker arm fulcrum-engaging surface to define a variable fulcrum point, the position of said pivot arm determining the position of the variable fulcrum point along said rocker arm fulcrum-engaging surface, and a control element engaging said pivot arm for setting the position of said pivot arm.

2. A variable lift valve train in accordance with claim 1, said valve train being included within an internal combustion engine, and said control element serving to move said pivot arm in a direction towards a portion where the variable fulcrum point is positioned for maximum movement of said valve with movement of said valve actuator as engine RPM increases.

3. A variable lift valve train in accordance with claim 1, wherein said rocker arm fulcrum-engaging surface has a semi-cylindrical curvature defined as a locus equidistant from said pivot point of said variable-position fulcrum assembly.

4. A variable lift valve train in accordance with claim 1, wherein said variable-position fulcrum assembly further includes:

a biasing element connected to said pivot arm for biasing said pivot arm in a direction towards a position where the variable fulcrum point is positioned for minimum movement of said valve with movement of said valve actuator;

said control element comprising a control piston received in a piston bore and having a piston tip element engaging said pivot arm, said control piston and piston bore arranged such that movement of said control piston in a direction out of said bore moves said pivot arm in a direction towards a position where the variable fulcrum point is positioned for maximum movement of said valve with movement of said valve actuator; and a passageway for introducing hydraulic fluid under pressure into said piston bore for moving said control piston in a direction out of said bore.

5. A variable lift valve train in accordance with claim 4, wherein said variable-position fulcrum assembly further includes:

said pivot arm including a push plate attached to said pivot arm; and said piston tip element engaging said push plate, and said control piston and piston bore arranged for movement of said piston along a path generally at a right angle to said push plate.

6. A variable lift valve train in accordance with claim 5, wherein said piston tip element comprises a roller mounted for free rotation on a tip element shaft.

7. A variable lift valve train in accordance with claim 6, which further comprises needle bearings between said tip element shaft and said tip element roller.

8. A variable lift valve train in accordance with claim 4, said valve train being included within an internal combustion engine having an oil pressure lubrication system driven by a pump such that oil pressure depends upon engine RPM, and the hydraulic fluid introduced through said passageway being engine lubrication oil such that the decree of movement of said valve with movement of said valve actuator increases with increasing engine RPM.

9. A variable lift valve train in accordance with claim 8, which further comprises a pressure relief element for limiting the oil pressure which may be applied through said passageway to said control piston, thereby limiting the degree of movement of said valve with movement of said valve actuator.

10. A variable lift valve train in accordance with claim 1, wherein said other end of said rocker arm engaging said valve actuator comprises an adjustment element for adjusting clearance between said valve actuator and said rocker arm.

11. A variable lift valve train in accordance with claim 1, wherein:

said cam comprises an overhead cam proximate said rocker arm;

said other end of said rocker arm comprises a cam follower roller;

an adjustable shaft, said cam follower roller being mounted for free rotation on said adjustable shaft; and said adjustable shaft including a radially offset longitudinal bore receiving a mounting element about which said adjustable shaft may be eccentrically rotated for adjustment, said mounting element including means for fixing said adjustable shaft in a desired adjusted position.

12. A variable lift valve train in accordance with claim 11, which further comprises needle bearings between said adjustable shaft and said cam follower roller.

13. A variable lift valve train in accordance with claim 4, wherein said other end of said rocker arm engaging said valve actuator comprises an adjustment element for adjusting clearance between said valve actuator and said rocker arm.

14. A variable lift valve train in accordance with claim 4, wherein:

said cam comprises an overhead cam proximate said rocker arm;

said other end of said rocker arm comprises a cam follower roller;

an adjustable shaft, said cam follower roller being mounted for free rotation on said adjustable shaft; and said adjustable shaft including an offset longitudinal bore receiving a mounting element about which said adjustable shaft may be eccentrically rotated for adjustment, said mounting element including means for fixing said adjustable shaft in a desired adjusted position.

15. A variable lift valve train in accordance with claim 1, which further comprises:

said valve including a valve stem constrained for axial movement;

said one end of said rocker arm including a semi-spherical recess; and a hat element mounted on said valve stem and having a semi-spherical portion engaging said semi-spherical recess for positively locating said rocker arm.

* * * * *